United States Patent [19]

Falconieri et al.

[11] Patent Number: 4,881,837

[45] Date of Patent: Nov. 21, 1989

[54] AUTOMATIC SHEET FEEDER

[75] Inventors: Remo Falconieri, S. Giorgio; Sergio Uggetti, Ivrea, both of Italy

[73] Assignee: Ing. C. Olivetti & C., S.p.A., Ivrea, Italy

[21] Appl. No.: 60,066

[22] Filed: Jun. 9, 1987

[30] Foreign Application Priority Data

Jun. 16, 1986 [IT] Italy ..... 67491 A/86

[51] Int. Cl.[4] ..... B41J 13/036

[52] U.S. Cl. ..... 400/625; 400/629; 400/631; 400/570; 400/551; 271/9

[58] Field of Search ..... 400/551, 570, 624, 625, 400/628, 629, 631, 630; 271/9

[56] References Cited

U.S. PATENT DOCUMENTS

| | | | |
|---|---|---|---|
| 4,248,415 | 2/1981 | Steinhilbo | 400/629 |
| 4,262,894 | 4/1981 | Marano | 400/625 |
| 4,268,021 | 5/1981 | Rutishauser et al. | 400/625 |
| 4,475,731 | 10/1984 | Wood | 400/629 |
| 4,523,869 | 6/1985 | Martin | 400/629 |
| 4,667,947 | 5/1987 | Costa et al. | 400/625 |
| 4,717,136 | 1/1988 | Rutishonser | 271/9 |

FOREIGN PATENT DOCUMENTS

| | | | |
|---|---|---|---|
| 3441487 | 5/1986 | Fed. Rep. of Germany | 400/629 |
| 3512419 | 10/1986 | Fed. Rep. of Germany | 400/629 |
| 185673 | 10/1984 | Japan | 400/629 |
| 188465 | 10/1984 | Japan | 400/629 |
| 42079 | 3/1985 | Japan | 400/629 |
| 149379 | 7/1986 | Japan | 400/629 |

OTHER PUBLICATIONS

Hunt, "Paper Aligning Apparatus", IBM Technical Disclosure Bulletin vol. 27, No. 1A, pp. 216–217, Jun. 1984.

The Hn "Dual Action . . . Feeder" Xerox Disclosure Journal vol. 8, No. 5, pp. 405–407 Sep/Oct. 1983.

*Primary Examiner*—William Pieprz

*Attorney, Agent, or Firm*—Banner, Birch, McKie & Beckett

[57] ABSTRACT

The sheet feeder can be mounted on a typewriter or on a printer in a system for processing data. The sheets which are accommodated in a feed magazine are passed to the platen roller by friction stripper rollers. After the printing operation, the sheets are passed on to a collection table positioned in front of the feed magazine. The stripper rollers are permanently connected to the platen roller by way of a mechanical transmission and rotate in the same direction as the platen roller. The stripper rollers are mounted on an oscillating arm to be selectively moved towards or away from the first sheet to be fed, by means of a first cam. Before a fresh sheet is fed, a second cam, also coupled to the platen roller, has to be brought to a reference position by rotating the platen roller enough to expel the current sheet. The platen roller is then rotated in the reverse direction, whereby the second cam actuates a lever, thereby to close a clutch. During subsequent rotation of the platen roller in the forward direction, the clutch rotates the first cam through one revolution for engaging the stripper rollers with the top sheet, thereby effecting stripping and feed of a sheet. At the end of the rotary movement through one revolution of the cam, the stripper rollers are moved away from the sheets and the clutch is opened, making the cams inoperative independently of subsequent rotary movements of the platen roller in one direction or the other.

4 Claims, 3 Drawing Sheets

AUTOMATIC SHEET FEEDER

BACKGROUND OF THE INVENTION

The present invention relates to an automatic sheet feeder for a typewriter or like office machine, with a platen roller, comprising a feed device with a friction stripper roller, the device being selectively actuable by the platen roller for feeding individual sheets from a pack of sheets disposed in a magazine to the platen roller of the typewriter, the stripper roller being connected to the platen roller by means of a mechanical transmission.

Various types of sheet feeder of the above-indicated kind have been proposed. In one type the mechanical transmission which makes the connection between the platen roller of the typewriter and the stripper roller comprises a free wheel. The free wheel operates in such a way that, when the platen roller rotates in the opposite direction to the feed movement of a sheet, the stripper roller is positively rotated to feed a sheet towards the platen roller while when the platen roller is rotated in the direction of feed movement of the sheet, the stripper roller is not rotated.

This known feeder suffers from the disadvantage that the stripper roller feeds a sheet whenever the platen roller is rotated in the opposite direction to the feed movement, for example to carry out corrections in previously typed or printed lines, thereby giving rise to blockages in the subsequent feed of further sheets.

SUMMARY OF THE INVENTION

The object of the present invention is to provide a sheet feeder which does not suffer from the above-indicated disadvantages, which is of a simple construction and which is easy to use on the part of the operator.

Another object of the invention is to provide a sheet feeder in which the stripper roller is rotated in the direction for feeding a sheet when the platen roller rotates in the forward feed direction, and comprising feed control means responsive to a reverse rotation of the platen roller to cause the stripper roller to move into engagement with the top sheet of the pack, whereby subsequent rotation of the platen roller in the forward feed direction will feed a sheet from the pack.

The invention will be described in more detail, by way of example, with reference to the accompanying drawings.

DETAILED DESCRIPTION OF THE PREFERRED EMBODIMENTS

Figures 1, 3:
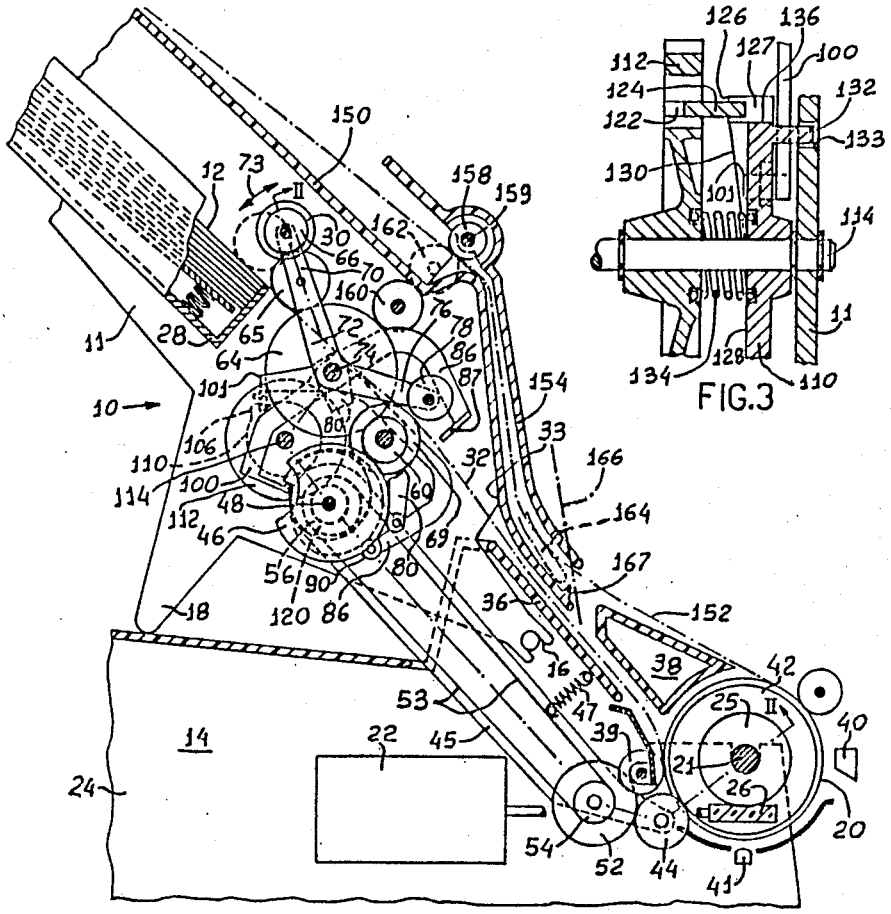
FIG. 1 is a diagrammatic side view of a sheet feeder embodying the invention.
FIG. 3 is a view of detail of the feeder in section taken along line III—III in FIG. 2.

Referring to FIG. 1, the feeder 10 for sheets 12 is mounted on a typewriter 14 by means of the latching device 16 and a support leg 18.

The feeder 10 derives the movement for its own components directly from a platen roller 20 of the typewriter in a manner which will be described hereinafter.

The platen roller 20 is rotated by a motor 22 mounted on the frame structure 24 of the typewriter 14, by means of a pair of gears 25 and 26. The motor 22 is controlled by logic circuits of the typewriter, comprising a control unit and a memory which are not illustrated in the drawings.

The fresh sheets of paper 12 are accommodated in a feed magazine 28 which is disposed in the upper part of the feeder, rearwardly with respect to the platen roller 20.

The sheets 12 are stripped one by one by friction stripper rollers 30 and passed to the platen roller 20 along a path 32 defined by a wall 33 of the feeder 10, a wall 36 and a wedge-shaped guide 38 which are part of the typewriter 14. The sheets 12 are fed to the platen roller 20 by means of pressure rollers 39 in a rearward zone of the platen roller 20 with respect to a print member which is diagrammatically indicated at 40 in FIG. 1.

Fixed on a shaft 21 of the platen roller 20 is a gear 42 with which a toothed gear 44 of the feeder 10 engages when the latter is mounted on the typewriter, in the position shown in FIG. 1. The movement is transmitted from gear 44 to a gear member 46 which is secured on a rotatable shaft 48 by means of a toothed gear 52, and a belt 53 which passes around two pulleys 54 and 56 of which the pulley 56 is fixed on the shaft 48 and thus also on the gear member 46. The gears 44 and 52 are mounted on an arm 45 which is pivoted on the shaft 48 and held by a spring 47 to ensure engagement between the gears 44 and 42. The gear member 46 in turn transmits the movement to the stripper rollers 30 by way of toothed gears 60, 64, 65 and 66.

The gear 60 is fixed with respect to a row of rollers 69 for advancing the sheets and is disposed downstream of the stripper rollers 30, along the path of movement 32.

The gears 65 and 66 are mounted on an arm 70 of a rocker lever 72 which is pivoted on a shaft 74 on which the bear member 64 rotates. Mounted on another arm 76 of the lever 72 are idle rollers 78 which co-operate selectively with the advance rollers 69 to advance a sheet of paper, as will be described hereinafter.

The lever 72 is fixed with respect to a third arm 80 (see FIG. 2) which at an end 81 carries a cam follower 82 co-operating with a cam 84 which is rotatable on the shaft 48.

The lever 72 normally remains in a rest position as shown in FIG. 1 in which both the rollers 30 and the rollers 78 are respectively moved away from the sheets 12 and the rollers 69. The lever 72 can be rotated by the cam 84 in the two directions indicated by an arrow 73. When it is rotated in the anti-clockwise direction, the lever 72 brings the rollers 30 into contact with the top sheet 12 to separate it from the subjacent sheets and to extract it from the magazine 28.

When it is rotated in the clockwise direction, the lever 72 moves the rollers 30 away from the sheets 12 and brings the rollers 78 into a position against the rollers 69 in order subsequently to advance the sheet along the path 32.

Pivotally mounted on the shaft 74 is a lever 86 carrying a registration ruler 87 which is disposed downstream of the rollers 69 and which is used for correctly aligning each sheet before passing it to the platen roller 20.

The lever 86 is moved by means of a cam follower 90 rolling against a cam 92 mounted on the shaft 48. The cams 84 and 92 are loosely rotatable on the shaft 48 and are fixed with respect to each other and the driven portion 94 of a clutch 95 whose driving portion 97 is fixed with respect to the pulley 56 and the shaft 48. The clutch 95 is normally open and is closed selectively by means of an end 98 of a lever or a clutch control member 100 engaged with a tooth 102 of the clutch 95 under the force of a spring 99. The lever 100 is pivoted on the shaft 74 and has another end 101 engaged with a projection 106 on a disc 110 (see FIGS. 2 and 3) which is driven in rotation by a gear member 112. The gear member 112 and the disc 110 are rotatable on a shaft 114. The member 112 engages with a toothed gear 120 which is fixed with respect to the pulley 56.

Mounted on the gear member 112 (see FIGS. 2 and 3), with a resilient connection 122, is an axially projecting peg 124 engaged with a tooth 126 provided on a face 128 of the disc 110. The back 129 of the tooth 126 goes down with an inclined surface 130 in the form of a circular ring which is connected to the face 128 of the disc 110.

Figure 2:
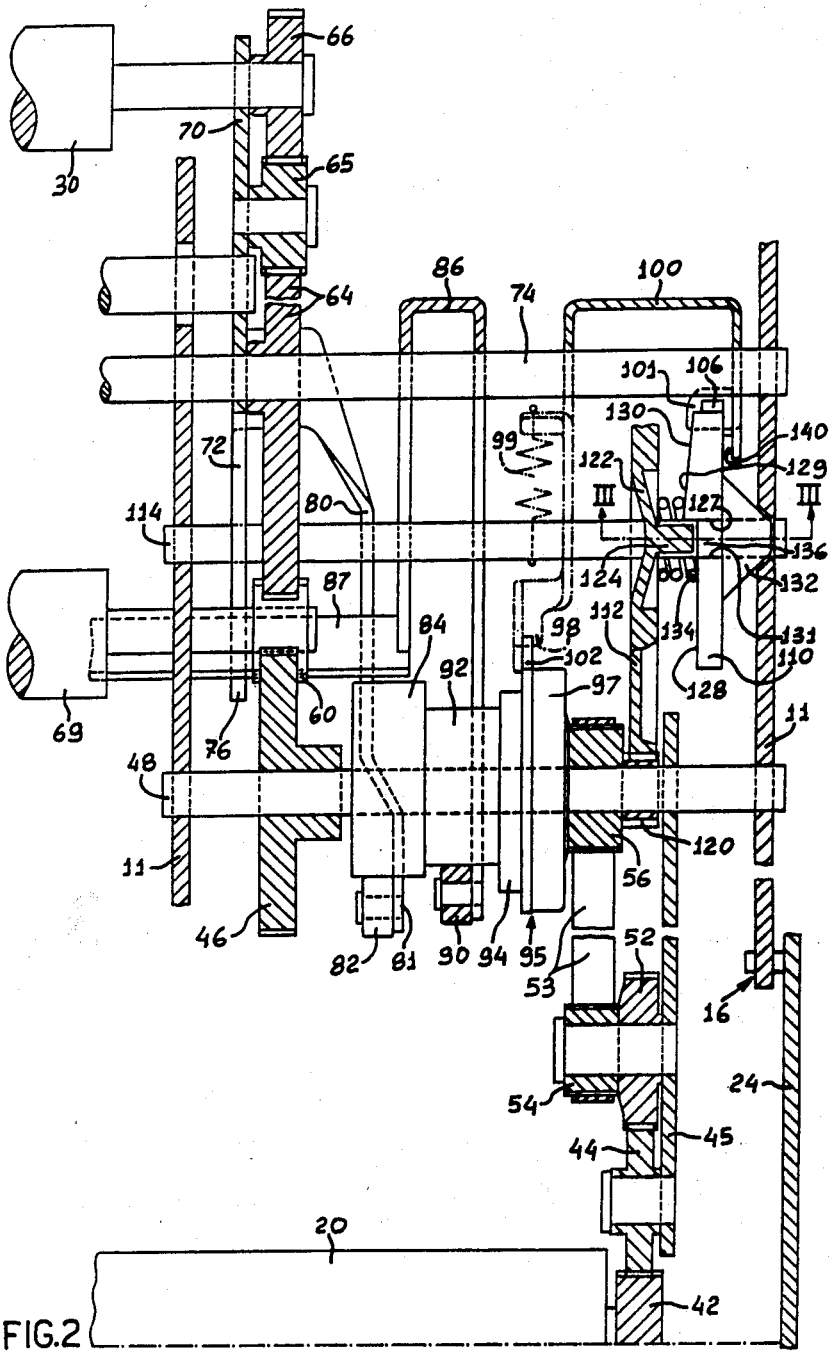
FIG. 2 is a view of the feeder in section along line II—II in FIG. 1.

The disc 110 is held in a predetermined reference position as shown in FIGS. 2 and 3 by an axial projection 132 which is urged against a seat 133 in the frame structure 11 by an axial spring 134 interposed between the member 112 and the disc 110. The disc 110 is further provided with a recess 136 disposed in a position corresponding to the tooth 126. The recess 136 has sides 127 and 131 of different lengths.

When therefore the gear member 112 is rotated for example in the anti-clockwise direction (FIG. 1), the disc 110 is driven in rotation by the peg 124 which is engaged with the longer side 127 (FIGS. 2 and 3). Due to the action of the projection 132, the disc 110 is moved towards the member 112 against the force of the spring 134. At the same time the peg 124 passes into the recess 136 whereby, when the direction of rotation of the member 112 is reversed, the disc 110 is rotated backwards by the peg 124 engaged with the short side 131, until the projection 132 passes into the seat 133 again.

In that position the disc 110 is moved away from the member 112 and the peg 124 comes out of the recess 136, being disengaged from the side 131 of the disc 110, which remains locked in its reference position.

When therefore the member 112 continues to rotate in the clockwise direction, the peg 124 rises by sliding along the surface 130 until it passes over the tooth 126, by virtue of the yielding nature of the resilient connection 122 of the peg 124.

The mode of operation of the feeder according to the present invention is set out below.

In response to a suitable command from the operator, the logic arrangement of the typewriter actuates the stepping motor 22 to rotate the platen roller 20 backwards, that is to say in the opposite direction to the feed movement of a sheet, for example in the clockwise direction in FIG. 1. The roller 20 is thus caused to rotate backwards by a predetermined number of steps which has been stably stored in the memory, in such a way that the disc 110, being entrained in the anti-clockwise direction by the peg 124 (see FIGS. 2 and 3) and after a rotary movement of around 340°, brings the projection 106 under the end 101 of the lever 100.

The lever 100 thus releases the tooth 102 of the clutch 95 which is closed. At that point the logic arrangement of the typewriter reverses the direction of rotation of the roller 20.

The shaft 48 and the clutch 95 are then rotated in an anti-clockwise direction, also rotating the cams 84 and 92 while the disc 110 is now rotated in the clockwise direction by the peg 124.

During that phase, the cam 84 moves the lever 72 in the anti-clockwise direction (FIG. 1) in such a way as to move the rollers 30 into the broken-line position to commence the feed of the top sheet 12. At the same time the cam 92 lowers the ruler 87.

The rollers 30 are kept in contact with the sheet 12 until the front edge thereof bears against the ruler 87. At that point the cam 92 lifts the ruler 87, thus releasing the sheet 12, and the cam 84 rotates the lever 72 in the clockwise direction, moving the rollers 30 away from the sheet 12 and moving the rollers 78 towards the advance rollers 69. The latter now provide for advance movement of the sheet 12 along the path 32 until the sheet reaches the platen roller under the pressure rollers 39.

While the leading edge of the sheet is advanced by the platen roller 20 along the line between the pressure rollers 39 and a sensor 41 which is disposed underneath the platen roller 20, the cam 84 rotates the lever 72 in the anti-clockwise direction, stopping it in the rest position shown in FIG. 1 in which both the rollers 78 and the rollers 30 are moved away from the path 32 of movement of the sheet 12.

At that point the disc 110 which is entrained by the peg 124 has completed its rotary movement in a clockwise direction through 340°, which was previously covered in the anti-clockwise direction, and is blocked by the projection 132 in the reference position in FIG. 2. At the same time a tooth 140 disposed on a face of the disc 110 laterally displaces the lever 100 which causes opening of the clutch 95 and consequential stopping of the cams 84 and 92.

The platen roller 20 continues to rotate in the anti-clockwise direction to bring the sheet 12 into the position for printing thereon in front of the printing member 40.

The transmission ratio between the platen roller 20 and the gear member 112 is such that a complete revolution of the member 112 and the disc 110 corresponds to the complete feed movement of a sheet of standard length, for example of A4 format, while a rotational movement of the member 112 and the disc 110 through 340° corresponds to the length between the first and last typed or printed lines.

Therefore when the sheet 12 has been advanced by the platen roller 20 and is in the position for printing or typing on the last line thereof, the member 112 has almost completed a revolution in the clockwise direction and the peg 124 has slid along the inclined surface 130 without however passing over the tooth 126.

It is thus possible to reverse the direction of rotation of the platen roller 20 to move the sheet forwards and backwards any number of times without activating the stripper rollers 30 since the peg 124 of the member 112 moves forwards and backwards along the inclined surface 130 without engaging the tooth 126 and thus the disc 110 remains blocked and the clutch 95 is not closed. It is only when the sheet 12 is advanced beyond the last line of printing or typing to be expelled with a subsequent rotary movement of the roller 20 that the peg 124 passes over the tooth 126 and returns to the initial conditions for a subsequent feed of a second sheet.

At the end of the type operation, the sheet 12 is passed to a collection table 150 (see FIG. 1) disposed in front of the feed magazine 28. The sheet is pushed by the roller 20 along the exit path 152 between the wall 33 and a movable guide 154 until the sheet is entrained by the rollers 158 which are rotated by the gear member 64 by way of the gears 160 and 162. The guide 154 can be rotated in a clockwise direction about the shaft 159 of the rollers 158 from the position shown in FIG. 1 to a position 164 beside the wall 33. With the guide 154 in the second position 164, an auxiliary passage 166 is made available, by way of which a sheet can be manually introduced to be wound around the roller 20, passing into the lower part of the main path 32. The manually introduced sheet is collected above the guide 154, on which it is guided by a projection 167 which helps with passing over the thickness of the guide 154.

Figure 4:
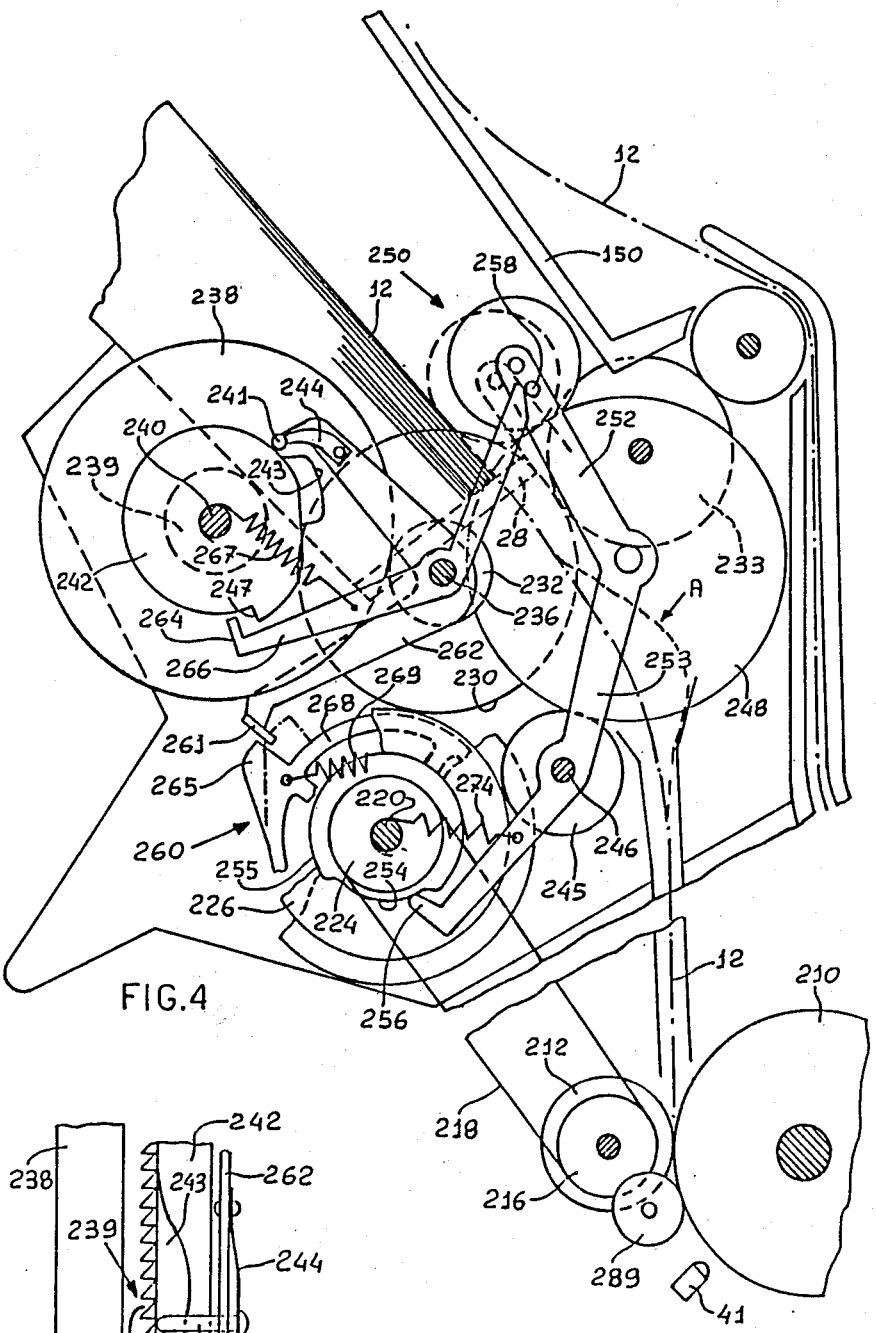
FIG. 4 is a side view of a second embodiment of the invention.
Figure 5:
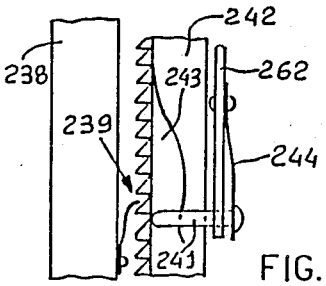
FIG. 5 is a fragmentary view of a detail of FIG. 4.

In the second embodiment of the sheet feeder shown in FIGS. 4 and 5 it is possible to eliminate the ruler member 87 (FIG. 2), the associated control members 86, 90, 92 and the rollers 69 and 78.

The platen roller 210 transmits the movement to the pulley 224 by way of the gear member 212, the pulley 216 and the belt 218. The pulley 224 is mounted on a shaft 220 fixedly with respect to a gear member 226. The gear member 226 rotates the toothed sheets 230 and 232 which are fixed with respect to each other and rotatable on a fixed shaft 236. The wheel 232 meshes with a gear wheel 238 which is rotatable on a shaft 240 and connected by means of a unidirectional clutch 239 to a cam 242 which is coaxial therewith and which has a lobe 243.

The toothed wheel 230 through the toothed roller 233 engages the roller 235 which is used for expelling a sheet 12 on to a collection shelf 150.

The gear member 226 further engages with the gear member 245 which is rotatable on a fixed shaft 246 and which is connected to stripper rollers 250 by way of a toothed wheel 248. The rollers 250 and the rear member 248 are rotatable on an arm 252 of a lever 253 which is pivoted on the shaft 246 and rotated by a cam 254 rotatable on the shaft 220. The cam 254 is provided with a lobe 255 co-operating with a cam follower portion 256 of the lever 253. The cam 254 is rotated by the pulley 224 by way of a clutch 260 of known type which is closed selectively by a tooth 261 of a lever 262 pivotally mounted on the shaft 236 and rotated by the lobe 243 of the same 242.

The mode of operation is as follows:

The roller 210 is first rotated in the direction of forward feed movement of the sheet 12, for example in the anti-clockwise direction in FIG. 4, until the gear member 238 has been rotated through 360° in the clockwise direction. In that way the cam 242 is rotated into a reference position in which a shoulder 247 on the cam 242 engages against a tooth 264 of a lever 266 pivotally mounted on the shaft 236 and held in the position shown in FIG. 4 by a spring 267. The lobe 243 is of such a configuration (see FIG. 5) that the cam follower 241 passes laterally therebeyond when the cam 242 rotates in the clockwise direction, without rotating the lever 262. The cam follower 241 is mounted on a resilient tongue portion 244 which is fixed to the lever 262.

The unidirectional clutch 239 will rotate the cam 242 clockwise until the cam is arrested by the tooth 264. The clutch will always rotate the cam anti-clockwise when the wheel 238 rotates anti-clockwise.

During the initial rotation of the roller 210, the clutch 260 is open and the cam 254 remains stationary since the tooth 261 of the lever 262 bears against a raised portion 265 of a member 268 for controlling the clutch 260.

Subsequently the roller 210 is rotated through a small angle in the opposition direction to the direction of forward feed movement of the sheet 12, that is to say in the clockwise direction. The lobe 243 of the cam 242 rotates the lever 262 in the clockwise direction, whereby its tooth 261 remains raised beyond the portion 265 of the clutch 260. The member 268 is therefore displaced by a spring 269 into the position shown in dash-dotted lines, passing under the tooth 261. In that way the clutch 260 is closed and the cam 254 is connected to the pulley 224. This action only takes place when the cam 242 is rotated anti-clockwise from the reference position, i.e. after a complete rotation of the gear wheel 238 corresponding to a complete feed movement. Prior to completion of a feed the wheel 238 can rotate the cam 242 back and forth without initiating the feed of a new sheet.

The roller 210 is then again rotated in the direction of forward feed movement of the sheet 12, that is to way in the anti-clockwise direction, to initiate the cycle of feeding a sheet. The pulley 224 rotates the cam 254 in the clockwise direction. The lever 253 is rotated by the cam 254 in the anti-clockwise direction to bring the stripper rollers 250 against the sheets 12. The lever 266 is rortated in the anti-clockwise direction by a peg 258 mounted on the arm 252 of the lever 253, so that the tooth 264 on the lever 266 is moved away from the shoulder 247, permitting the cam 242 to rotate fixedly with the wheel 238.

The tooth 261 bears on the outside against the portion 265 and does not impede rotation of the clutch 260 in the clockwise direction fixedly with respect to the pulley 224 and the cam 254. The sheet 12 is advanced along a path which is shown in dash-dotted lines to the sensor 41 disposed below the platen roller 210, beyond a pressure roller 289. The stripper rollers 250 advance the sheet 12 at a speed which is slightly higher than the peripheral speed of the platen roller 210 whereby the sheet forms a loop in the region indicated by the broken lines at A in FIG. 4. At that point the platen roller 210 is stopped and rotated in the direction opposite to the forward feed movement of the sheet 12 to align the sheet between the roller 289 and the roller 210. In that operation the rollers 250 rotate in the opposite direction but they do not eliminate totally the previously formed loop A. The sheet 12 is thus also urged by the residual loop between the rollers 289 and 210 which rotate in the direction of pushing the sheet back, so that alignment of the sheet is facilitated. After that the roller 210 is rotated again in the direction of forward feed movement of the sheet until the latter is positioned at the first line of typing in front of the printing member 40 (see FIG. 1). The wheel 226 and the cam 254 have completed a complete revolution, returning to the position shown in FIG. 4. The spring 274 rotates the lever 253 in the clockwise direction to move the rollers 250 away from the sheets 12. The lever 266 is returned to the initial position shown in FIG. 4 by the spring 267. The toothed 261 engages against the portion 265 to open the clutch 260. In that way the cam 254 is no longer rotated by the pulley 224 and thus the rollers 250 are no longer in a condition of bearing against the sheets 12, whereby it is possible for the roller 210 to rotate in one direction or the other to provide for line spacings forwardly or rearwardly, without feeding further sheets.

The tooth 264 is on the high part of the shoulder 247 of the cam 242 so that a complete clockwise revolution of this cam is again required before an anti-clockwise movement can initite a fresh sheet-feed.

We claim:

1. An automatic sheet feeding unit for a typewriter or like printing office machine having motor means for selectively rotating a platen roller in both a forward direction and a reverse direction with respect to the advancing movement of a sheet toward a printing position, said sheet feeding unit comprising a paper sheet magazine to hold said sheets to be fed to said platen, a separating roller rotatably connected with said platen through a mechanical motion transmission and mounted on a support member selectively rotatable from a rest position to an operating position to bring said separating roller into engagement with a first sheet to be fed to said platen roller, a first cam element cooperating with said support member for rotating the same in said operating position, an operable clutch device interposed between said platen roller and said first cam element for selectively connecting said first cam element with said motion transmission during a forward rotation of the platen roller subsequent to a first reverse platen rotation, a second cam element rotated by said motion transmission for actuating said clutch device when said platen roller rotates in said reverse direction, said second cam element being rotated in such a manner that one complete revolution of said second cam element corresponds to the maximum of the length of a sheet advanced by said platen roller during printing, said second cam element having a lobe and a stopping shoulder, said stopping shoulder stopping said second cam element in an angular reference position corresponding to the starting of said first reverse platen rotation, a clutch control member cooperating with said lobe and responsive to said first reverse platen rotation to actuate said clutch device, whereby during said subsequent forward platen rotation a sheet is advanced from said magazine towards said platen roller and for disabling said clutch device when said sheet is engaged by said platen roller at the completion of one revolution of said first cam element, and a rotatable lever having a first end cooperating with said support member and a second end, said lever being rotated by said support member in said operating position from a rest position in which said second end engages said shoulder for stopping said second cam element in said reference position, to an active position in which said shoulder overcomes said second end during said forward platen rotation, whereby said first cam element remains stopped, preventing said separating roller from being further engaged with a second sheet in the magazine during both forward and reverse platen rotations occurring after a fed sheet has been engaged by said platen roller.

2. A sheet feeding unit according to claim 1, wherein said clutch control member is responsive to said reverse platen rotation only when said first reverse platen rotation occurs when said second cam element occupies said reference position, assumed at the completion of a complete feed of a preceding sheet by the platen roller.

3. A sheet feeding unit according to claim 1, wherein said forward rotation following said first reverse rotation of the platen roller to which the clutch control member is responsive, is a predetermined number of revolutions of the platen roller corresponding to the travel length of a sheet from said magazine to said platen roller and to a rotary movement in a first direction of the second cam of less than one revolution with respect to said respective position.

4. A sheet feeding unit according to claim 3, wherein said second cam is returned to the reference position during the subsequent rotary movement of the platen roller in the forward direction.

* * * * *